US005513457A

United States Patent [19]

Byrnes et al.

[11] Patent Number: 5,513,457

[45] Date of Patent: May 7, 1996

[54] PRESENTATION POCKET

[76] Inventors: Dawn M. Byrnes, 90 Titus Ave., Staten Island, N.Y. 10306; Michele L. Selbert, 355 E. 86th St., New York, N.Y. 10028

[21] Appl. No.: 340,524

[22] Filed: Nov. 16, 1994

[51] Int. Cl.[6] ..... B42F 5/00

[52] U.S. Cl. ..... 40/405; 40/359; 283/37

[58] Field of Search ..... 40/661, 159, 359, 40/158.1, 405, 537, 649, 642; 283/36, 37, 39, 41; 402/3

[56] References Cited

U.S. PATENT DOCUMENTS

| | | | |
|---|---|---|---|
| 1,320,683 | 11/1919 | Goodhue | 40/661 X |
| 3,940,778 | 2/1976 | Craig et al. | 40/159 X |
| 5,170,889 | 12/1992 | Cue | 283/36 X |
| 5,316,404 | 5/1994 | Hansel | 40/159 X |
| 5,320,275 | 6/1994 | Williams | 283/37 X |

FOREIGN PATENT DOCUMENTS

| | | | |
|---|---|---|---|
| 135044 | 11/1919 | United Kingdom | 40/159 |

*Primary Examiner*—Brian K. Green

[57] ABSTRACT

A presentation pocket having a rigid support plate, with a transparent pocket structure mounted to an interior wall of the support plate, and the pocket structure sized dimensionally smaller than the interior wall, with the pocket structure having pleated side and bottom walls to accommodate expansion and various materials to be placed within the pocket structure. Tabs are arranged for demarcation of material contained within the pocket structure.

7 Claims, 5 Drawing Sheets

PRESENTATION POCKET

TECHNICAL FIELD

The field of invention relates to presentation support structure, and more specifically to a presentation pocket wherein printed material to be visually viewed is arranged for securement and safety within a pocket construction.

BACKGROUND OF THE INVENTION

Prior art presentation structure typically employed folders and the like such as indicated in U.S. Pat. No. 4,284,227 for presentation and storage of materials, with other structure such as albums having facing pages of transparent pocket construction indicated in U.S. Pat. No. 5,119,574. A jacket structure is indicated in U.S. Pat. No. 3,943,645, with an insert holder having windows for viewing material indicated in U.S. Pat. No. 5,161,827.

SUMMARY OF THE INVENTION

The present invention relates to a presentation pocket wherein the same is directed to a plate structure having a transparent forward accordion pleated pocket to accommodate materials of varying dimensions, with tab structure arranged for dividing printed material within the pocket as desired, as well as spaced openings for securing and positioning the pocket structure of the invention onto various supports and the like.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

Figure 1:
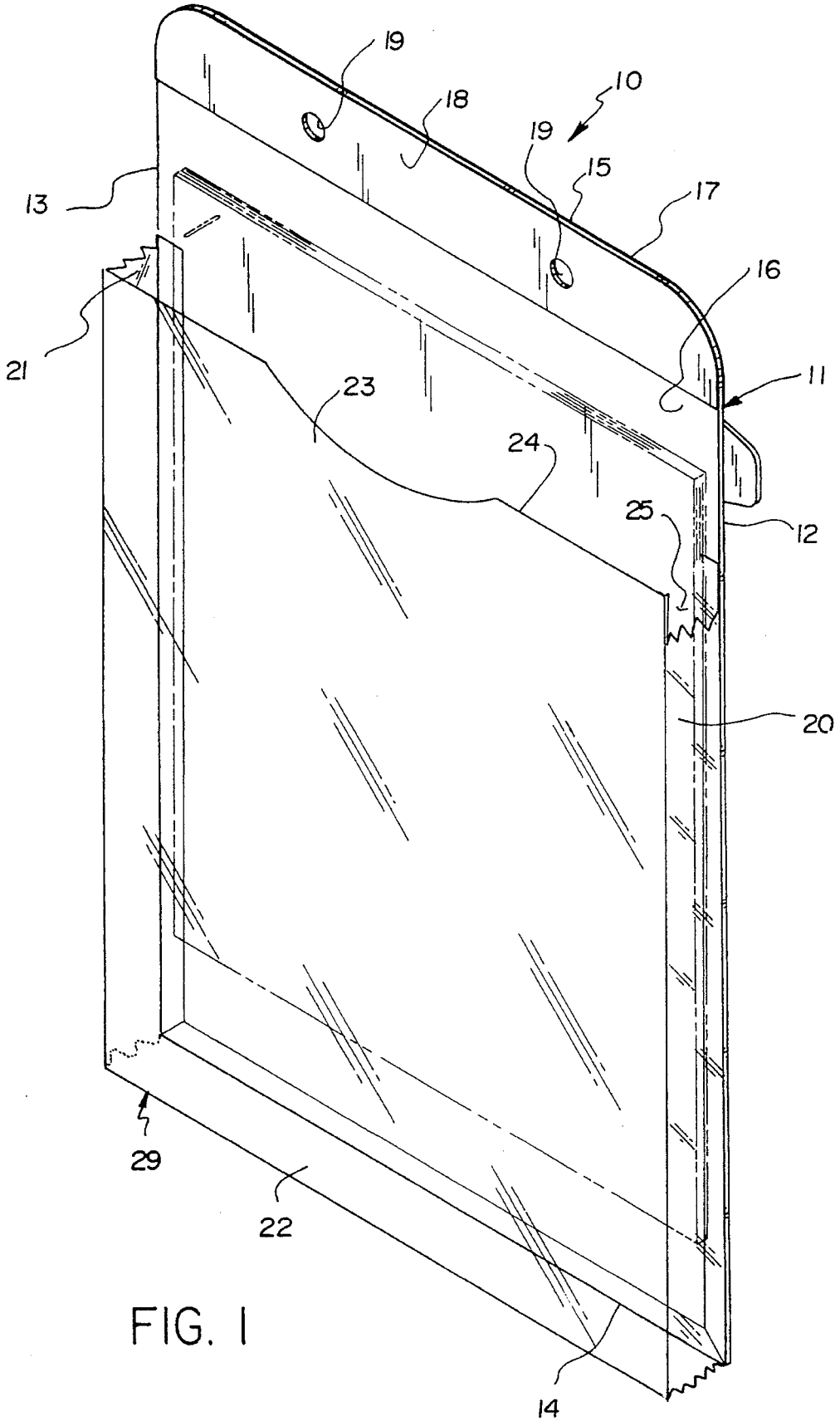
FIG. 1 is an isometric illustration of the invention.
Figure 2:
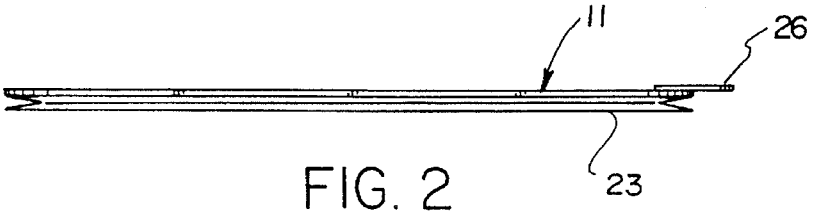
FIG. 2 is an orthographic top view of the invention.
Figure 4:
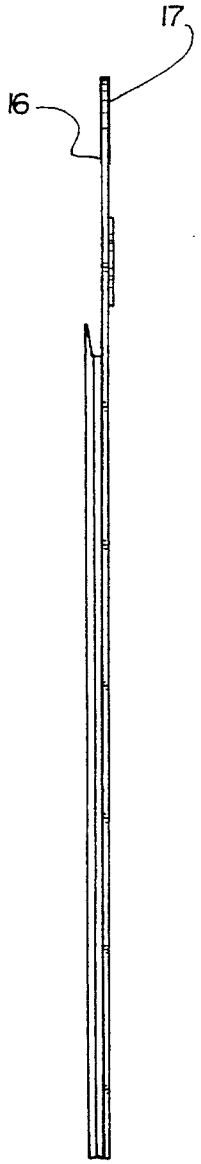
FIG. 4 is an orthographic side view of the invention.

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

The presentation pocket structure 10, as indicated by the FIGS. 1-8 of the invention, is arranged to include a rigid support plate 11 having a plate first side 12 coextensive and spaced from a plate second side 13, each defined by a first length. A plate bottom end 14 is spaced from a plate top end 15, with the plate defined by an interior wall spaced from an exterior wall 16 and 17 respectively. A reinforcing web 18 is directed along the interior wall 16 to provide for reinforcing of spaced openings 19 directed through the rigid support plate 11 adjacent to the plate top end 15, with the openings spaced beyond a pocket structure 29 of transparent construction.

Figure 5:
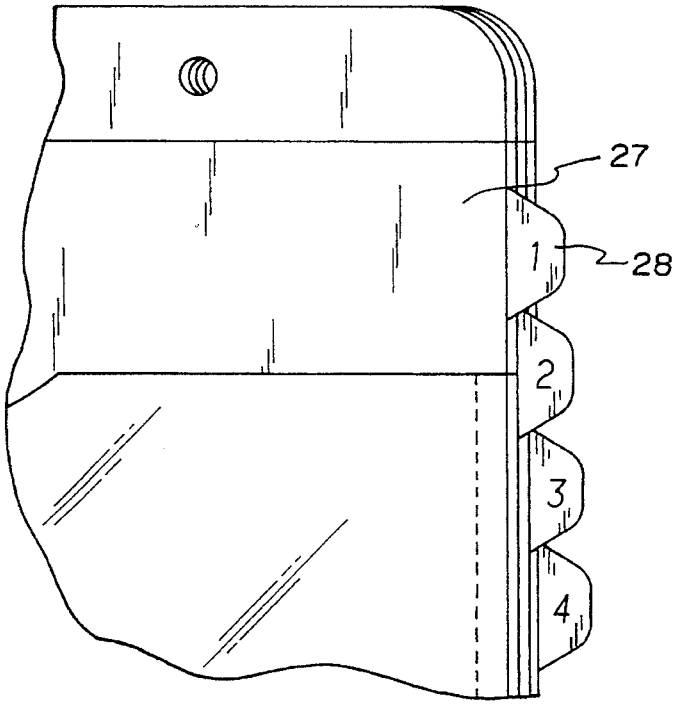
FIG. 5 is an isometric partial view of the invention indicating divider tab webs.
Figure 6:
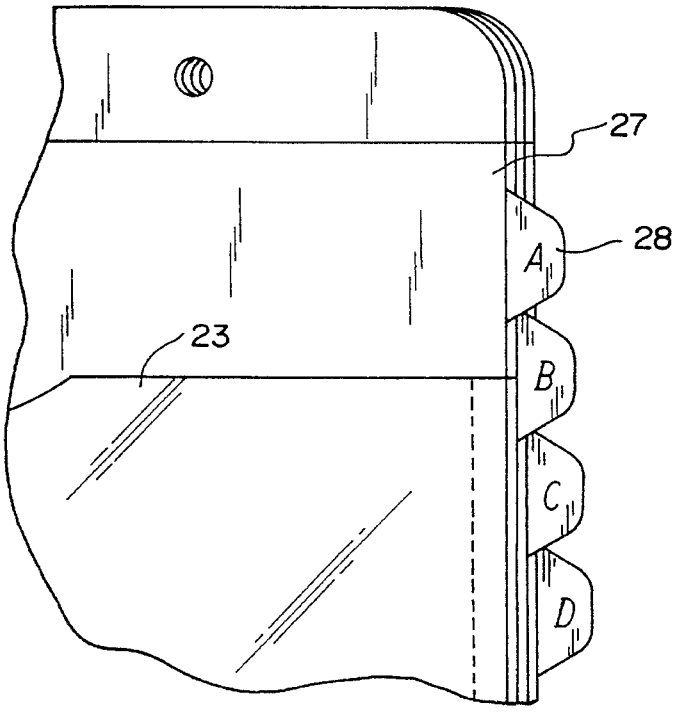
FIG. 6 is a further view indicating a variation of the tab web structure.
Figure 7:
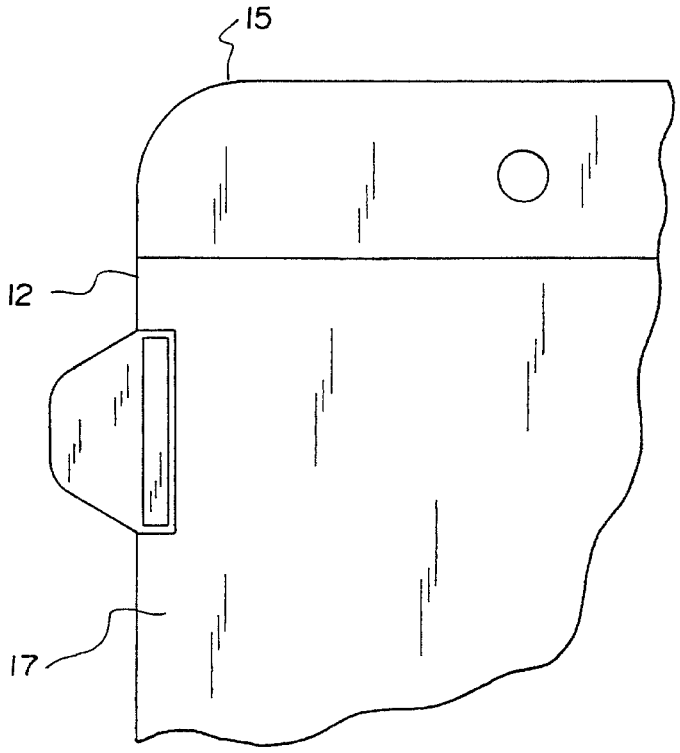
FIG. 7 is an isometric rear view of the invention support plate structure.
Figure 8:
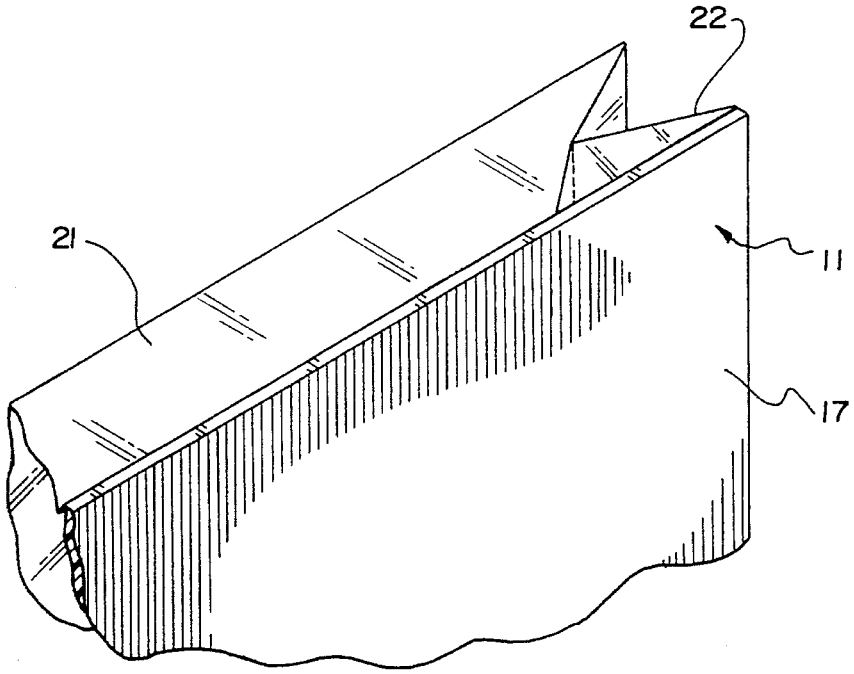
FIG. 8 is a partial isometric illustration of an accordion pleated side and bottom wall structure of the pocket construction of the invention.

The pocket structure 29 is defined by pleated and spaced first and second side walls 20 and 21 mounted to the plate's interior wall 16, with the pleated first side wall having a second length and the pleated second side wall 21 having a third length, with the second length less than the third length and the third length less than the aforenoted first length of the plate's first and second sides 12 and 13. A pleated bottom wall 22 is also provided as well as a front wall 23, with the front wall 23, the bottom wall 22, as well as the pleated first and second side walls 20 and 21 each formed of a transparent material. The front wall 23 is defined at its uppermost limit by a front wall upper edge 24 that is spaced from the openings 19. A first side wall opening 25 extending and originating from the front wall upper edge 24 extends into the pleated first side wall 20, such that insert webs 27, such as illustrated in FIGS. 5 and 6, may be provided, with each of the insert webs 27 having an insert web tab flange 28 to provide for separation of printed material and the like contained within the pocket structure 29. It should be noted that the support plate 11 may itself include a support plate tab flange 26, such that a plurality of such presentation pockets 10 may be demarcated within a support container such as a file cabinet and the like.

Figure 3:
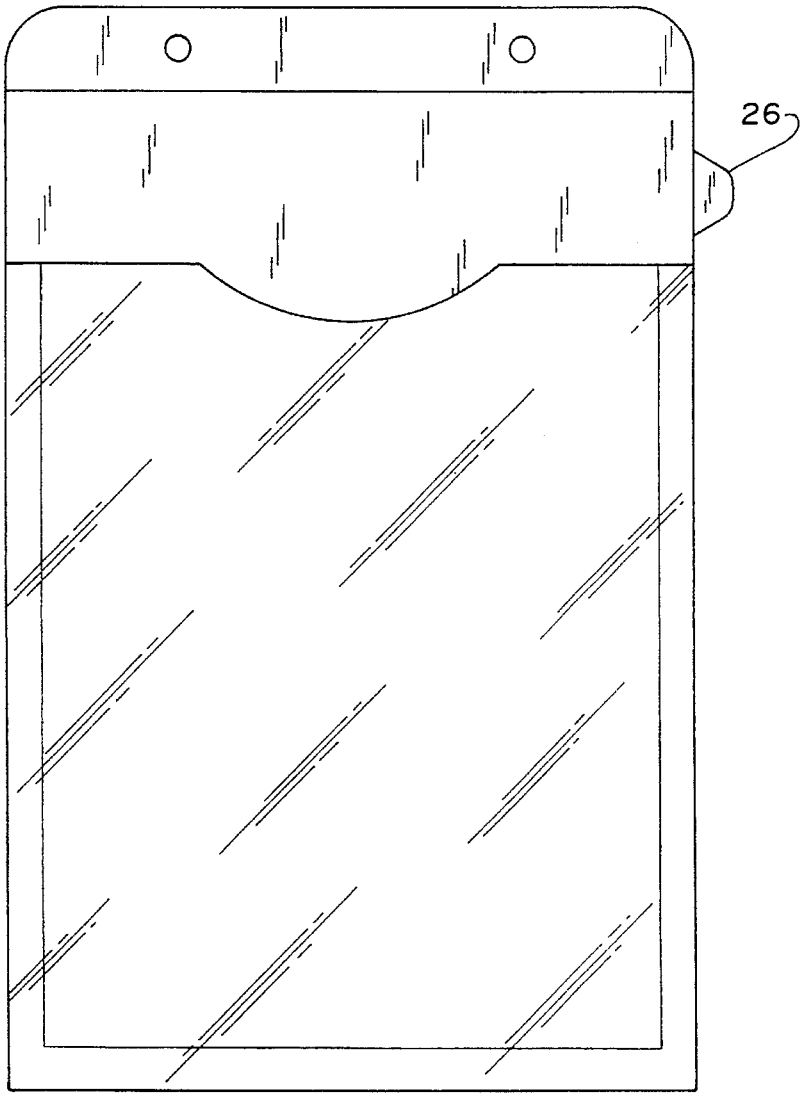
FIG. 3 is an orthographic frontal view of the invention.
Figure 3A:
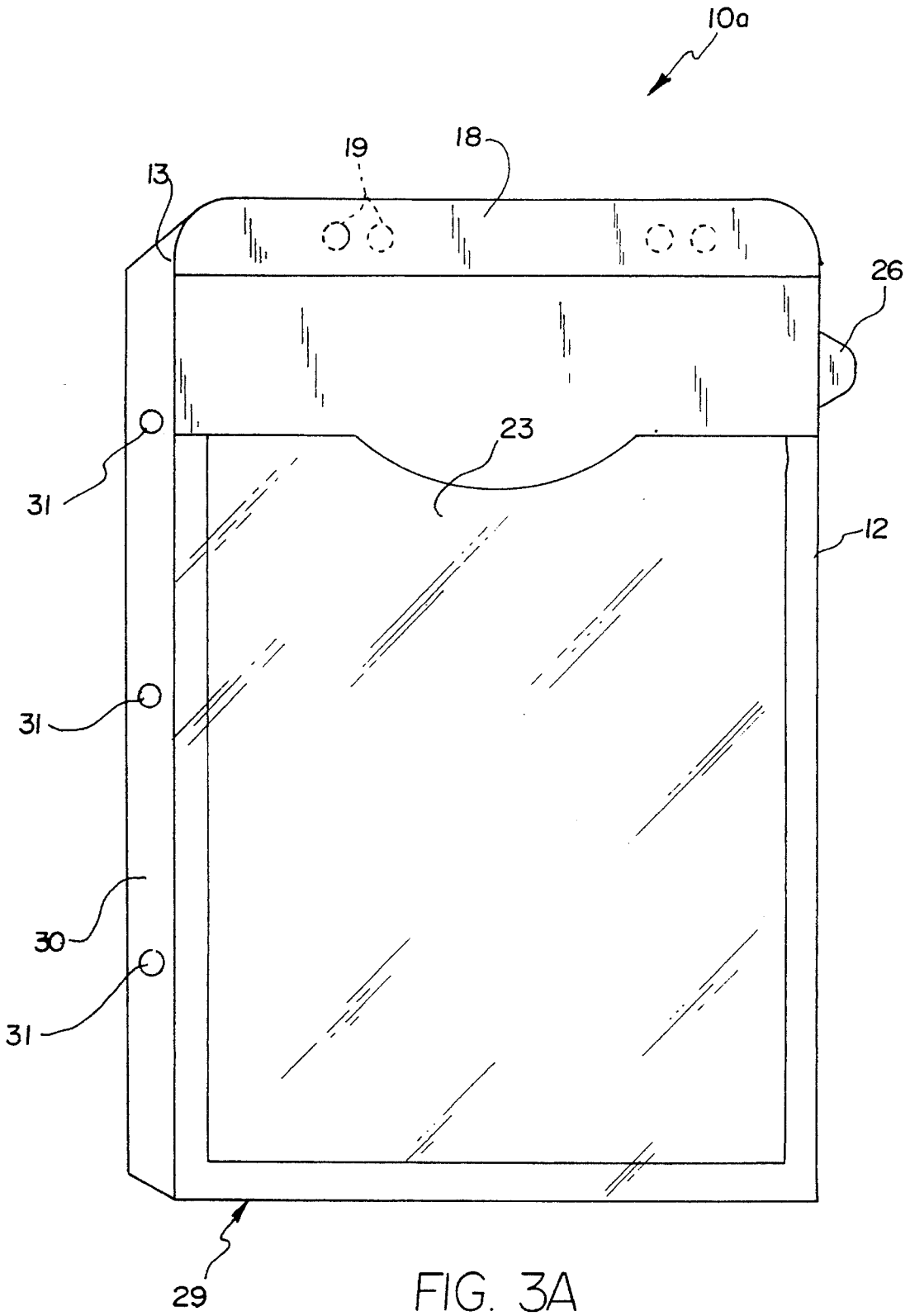
FIG. 3*a* is an orthographic frontal view of a modified aspect of the invention.

FIG. 3*a* indicates a modified presentation pocket structure 10*a*, wherein in addition to the structure of FIG. 10, the openings 19 may be either solid or perforated to permit the optional securement to a file folder but additionally, in hinged securement to the second side 13 is a projecting flange 30 that extends substantially coextensively relative to the second side 13, with the projecting flange 30 having a plurality of flange openings 31. The flange openings 31 permit the enhanced flexibility of the structure in application such as securement to a loose leaf binder (not shown) and the like for storage of the presentation pocket structure 10*a*, such as indicated in FIG. 3*a*.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by LETTERS PATENT of the United States is as follows:

1. A presentation pocket, comprising, a rigid support plate having a first side coextensive with a second side, and a bottom side spaced from a top side, the support plate having an interior wall spaced from an exterior wall, and a transparent pocket structure secured to the interior wall extending from the bottom side and in a spaced relationship relative to the top side;

wherein the pocket structure is secured to the interior wall at the first side and the second side;

wherein the first side and the second side are each of a first length, with the pocket structure having a pleated first side wall and a pleated second side wall, with the pleated first side wall of a second length and the pleated second side wall of a third length, with the second length less than the third length and the third length less than the first length.

2. A presentation pocket as set forth in claim 1 wherein the presentation pocket further includes a pleated bottom wall extending coextensively with the bottom end of the support plate.

3. A presentation pocket as set forth in claim 2 wherein the pocket structure includes a front wall, wherein the front wall, the bottom wall, the first side wall, and the second side wall are each transparent, and the front wall terminates in an upper edge spaced from the bottom wall.

4. A presentation pocket as set forth in claim 3 wherein the first side wall includes a first side wall opening originating at an upper edge of the first side wall, and at least one insert web received within the pocket structure, with the at least one insert web having an insert web tab flange projecting through the first side wall opening.

5. A presentation pocket as set forth in claim 4 wherein the support plate includes a support plate tab flange secured to the exterior wall projecting beyond the first side.

6. A presentation pocket as set forth in claim 1 wherein the second side includes a projection flange extending laterally of the transparent pocket structure, with the projection flange having a plurality of flange openings permitting the projection flange to be received within a loose leaf binder.

7. A presentation pocket comprising:

a rigid support plate having a first side spaced from a second side, and a bottom side spaced from a top side, the support plate having an interior wall spaced from an exterior wall, and a transparent pocket structure secured to the interior wall extending from the bottom side and in a spaced relationship relative to the top side;

wherein the first side and the second side are each of a first length, with the pocket structure having a pleated first side wall and a pleated second side wall, with the pleated first side wall of a second length and the pleated second side wall of a third length, with the second length less than the third length and the third length less than the first length.

* * * * *